US011313006B2

(12) United States Patent
Könberg et al.

(10) Patent No.: US 11,313,006 B2
(45) Date of Patent: Apr. 26, 2022

(54) PROCESS OF PRODUCING AN AUSTENITIC STAINLESS STEEL TUBE

(71) Applicant: Sandvik Intellectual Property AB, Sandviken (SE)

(72) Inventors: Erik Könberg, Älvsjö (SE); Daniel Svedberg, Gävle (SE)

(73) Assignee: Sandvik Intellectual Property AB, Sandviken (SE)

( * ) Notice: Subject to any disclaimer, the term of this patent is extended or adjusted under 35 U.S.C. 154(b) by 620 days.

(21) Appl. No.: 16/066,721

(22) PCT Filed: Dec. 28, 2016

(86) PCT No.: PCT/EP2016/082741

§ 371 (c)(1),
(2) Date: Jun. 28, 2018

(87) PCT Pub. No.: WO2017/114849

PCT Pub. Date: Jul. 6, 2017

(65) Prior Publication Data

US 2019/0017134 A1 Jan. 17, 2019

(30) Foreign Application Priority Data

Dec. 30, 2015 (EP) ..... 15203155

(51) Int. Cl.

| | |
|---|---|
| ***C21D 8/10*** | (2006.01) |
| ***C21D 9/08*** | (2006.01) |
| ***C22C 38/42*** | (2006.01) |
| ***C22C 38/44*** | (2006.01) |
| ***C22C 38/02*** | (2006.01) |
| ***C21D 7/02*** | (2006.01) |
| ***C21D 6/00*** | (2006.01) |
| ***C22C 30/02*** | (2006.01) |
| ***C22C 38/00*** | (2006.01) |
| ***C22C 38/04*** | (2006.01) |

(52) U.S. Cl.

CPC ..... *C21D 8/105* (2013.01); *C21D 6/004* (2013.01); *C21D 9/08* (2013.01); *C22C 30/02* (2013.01); *C22C 38/001* (2013.01); *C22C 38/02* (2013.01); *C22C 38/04* (2013.01); *C22C 38/42* (2013.01); *C22C 38/44* (2013.01); *C21D 7/02* (2013.01); *C21D 2211/001* (2013.01)

(58) Field of Classification Search

CPC ..... C21D 6/004; C21D 8/105; C21D 9/08; C21D 2211/001; C22C 38/40–58; C22C 30/02

See application file for complete search history.

(56) References Cited

U.S. PATENT DOCUMENTS

| | | | | |
|---|---|---|---|---|
| 6,905,652 | B2 * | 6/2005 | Ulfvin | C22C 38/004 420/586.1 |
| 2011/0067475 | A1 | 3/2011 | Murakami et al. | |
| 2011/0088819 | A1 * | 4/2011 | Semba | C22C 38/105 148/707 |
| 2011/0252854 | A1 * | 10/2011 | Suwabe | C22C 38/44 72/200 |
| 2014/0083576 | A1 * | 3/2014 | Sawawatari | C22C 38/02 148/707 |
| 2014/0348699 | A1 | 11/2014 | Chai et al. | |
| 2018/0066331 | A1 * | 3/2018 | Ponsiluoma | C22C 38/42 |

FOREIGN PATENT DOCUMENTS

| | | | |
|---|---|---|---|
| CN | 104962836 | A | 10/2015 |
| EP | 1777314 | A1 | 4/2007 |
| EP | 2380998 | A1 | 10/2011 |
| EP | 2388341 | A1 | 11/2011 |
| EP | 2690188 | A1 | 1/2014 |
| WO | 2009/014000 | A1 | 1/2009 |

OTHER PUBLICATIONS

CN104962836A English language translation (Year: 2015).*
Office Action dated Apr. 8, 2020, issued in corresponding European Patent Application No. 16822200.8.
Chen et al., "Development of UNS N08028 Oil Casing Pipe", Metal World, No. 3, Jan. 1, 2012, pp. 62-64, XP009190323.
International Search Report (ISR) and Written Opinion dated Mar. 24, 2017, issued in corresponding International Application No. PCT/EP2016/082741.

* cited by examiner

*Primary Examiner* — Anthony J Zimmer
*Assistant Examiner* — Sean P. O'Keefe
(74) *Attorney, Agent, or Firm* — Morgan, Lewis & Bockius LLP

(57) ABSTRACT

A process of producing an austenitic stainless steel tube comprises the steps of:

a) producing an ingot or a continuous casted billet of the austenitic stainless steel,
b) hot extruding the ingot or the billet obtained from step a) into a tube,
c) cold rolling the tube obtained from step b) to a final dimension thereof.

The outer diameter D of the cold rolled tube is 70-250 mm and the thickness t thereof is 6-25 mm, and the cold rolling step is performed such that the following formula is satisfied:

$$(2.5\times Rc+1.85\times Rh-17.7\times Q)=(Rp0.2\text{target}+49.3-1073\times C-21Cr-7.17\times Mo-833.3\times N)\pm Z \quad (1)$$

wherein Rp0.2target is targeted yield strength and is $750\leq R_{p0.2target}\leq 1000$ MPa, $30\leq Rc\leq 75\%$, $50\%\leq Rh\leq 90\%$, $1\leq Q\leq 3.6$, and Z is 65.

14 Claims, No Drawings

PROCESS OF PRODUCING AN AUSTENITIC STAINLESS STEEL TUBE

TECHNICAL FIELD

The present disclosure relates to a process of producing an austenitic stainless steel tube.

BACKGROUND

Stainless steel tubes having the composition defined herein are used in a wide variety of applications in which they are subjected to corrosive media as well as substantive mechanical load. During the production of such stainless steel tubes, different process parameters have to be set correctly in order to obtain a steel tube having the desired yield strength. Process parameters that have been found to have important impact on the final yield strength of the material of the tube are the following: degree of hot deformation, degree of cold deformation and ratio between tube diameter and tube wall reduction during the process in which a hot extruded tube is cold rolled to its final dimensions. These process parameters have to be set with regard to the specific composition of the austenitic stainless steel and the desired yield strength of the stainless steel tube.

Up to this point, prior art has relied upon performing extensive trials in order to find process parameter values resulting in the achievement of a target yield strength of austenitic stainless steel tubes. Such trials are laborious and costly. Therefore, a more cost-efficient process for determining process parameters crucial to the yield strength is desirable.

EP 2 388 341 suggests a process for producing a duplex stainless steel tube having a specific chemical composition, wherein the working ratio (%) in terms of reduction of area in the final cold rolling step is determined for a predetermined targeted yield strength of the tube by means of a given formula that also includes the impact of certain alloying elements on the relationship between working ratio and targeted yield strength. However, no further process parameters are included in the formula. Furthermore, there is no teaching of how to set process parameters such as degree of hot deformation, degree of cold deformation and ratio between tube diameter and tube wall reduction.

The present disclosure therefore aims at presenting a process for manufacturing a tube of an austenitic stainless steel by setting the degree of hot deformation, the degree of cold deformation and the ratio between tube diameter and tube wall reduction with regard to a specific targeted yield strength of the austenitic stainless steel and thereby improving the total manufacturing efficiency.

DETAILED DESCRIPTION

Hence, the present disclosure therefore relates to a process of producing an austenitic stainless steel tube, said steel having the following composition (in weight %),

| | |
|---|---|
| C | 0-0.3; |
| Cr | 26-28; |
| Cu | 0.6-1.4; |
| Mn | 0-2.5; |
| Mo | 3-4.4; |
| N | 0-0.1; |
| Ni | 29.5-34; |
| Si | 0-1.0; |

balance Fe and unavoidable or acceptable impurities, said process comprising the steps of a) producing an ingot or a continuous casted billet of the austenitic stainless steel, b) hot extruding the ingot or the billet obtained from step a) into a tube, c) cold rolling the tube obtained from step b) to a final dimension thereof, wherein the outer diameter D of the cold rolled tube is 70-250 mm and the thickness t thereof is 6-25 mm, wherein the cold rolling step is performed such that the following formula is satisfied:

$$(2.5\times Rc+1.85\times Rh-17.7\times Q)\leq(Rp0.2\text{target}+49.3-1073\times C-21\times Cr-7.17\times Mo-833.3\times N)\pm Z \quad (1)$$

wherein

Rc is degree of cold reduction and is defined as $$Rc = 1 - \frac{A1}{A0}, \quad (2)$$

wherein A1 is tube cross section area after cold deformation and A0 is tube cross section area before cold deformation, Rh is degree of hot reduction, and is defined as $$Rh = 1 - \frac{a1}{a0}, \quad (3)$$

wherein a1 is cross section of piece of steel after hot deformation and a0 is tube cross section area before hot deformation, i.e. hot extrusion, $$Q \text{ is } (W0-W1)\times(OD0-W0)/W0((OD0-W0)-(OD1-W1)) \quad (4)$$

wherein W1 is tube wall thickness after reduction, W0 is tube wall thickness before reduction, OD1 is outer diameter of tube after reduction, and OD0 is outer diameter of tube before reduction, Rp0.2target is targeted yield strength and is $750\leq R_{p0.2target}\leq 1000$ MPa, $30\%\leq Rc\leq 75\%$, $50\%\leq Rh\leq 90\%$, $1\leq Q\leq 3.6$, and Z is 65.

The relationship presented by formula (1) will make it possible to determine process parameter values for Rc, Rh and Q on basis of the composition of the austenitic stainless steel, i.e. the content of elements C, Cr, Mo and N.

Formula (1) could also be written as follows:

$$(Rp0.2\text{target}+49.3-1073\times C-21Cr-7.17\times Mo-833.3\times N)-Z\leq(2.5\times Rc+1.85\times Rh-17.7\times Q)\leq(Rp0.2\text{target}+49.3-1073\times C-21\times Cr-7.17\times Mo-833.3\times N)+Z.$$

Rc is defined as $$Rc = 1 - \frac{A1}{A0} \quad (2)$$

wherein A1 is tube cross section area after cold deformation and A0 is tube cross section area before cold deformation.

Rh is defined as $$Rh = 1 - \frac{a1}{a0} \quad (3)$$

wherein a1 is cross section of piece of steel after hot deformation and a0 is tube cross section area before hot deformation, i.e. hot extrusion.

According to one embodiment, Z=50. According to another embodiment, Z=20. According to yet another embodiment, Z=0.

The Q-value is the relationship between the wall thickness reduction and the reduction of the outer diameter, and is defined as follows:

$$Q \text{ is } (W0-W1)\times(OD0-W0)/W0((OD0-W0)-(OD1-W1)) \quad (4)$$

wherein W1 is tube wall thickness after reduction, W0 is tube wall thickness before reduction, OD1 is outer diameter of tube after reduction, and OD0 is outer diameter of tube before reduction.

On basis of the composition of the austenitic stainless steel and target yield strength of the tube to be produced, the values of Rc, Rh and Q may be set by means of an iterative calculation procedure which aims at finding those values for Rc, Rh and Q for which equation (1) is satisfied.

As to the composition of the austenitic stainless steel the following is to be noted regarding the individual alloying elements therein:

Carbon, C is a representative element for stabilizing austenitic phase and an important element for maintaining mechanical strength. However, if a large content of carbon is used, the carbon will precipitate as carbides and thus the corrosion resistance will be reduced. According to one embodiment, the carbon content of the austenitic stainless steel used in the process disclosed hereinbefore and hereinafter is 0 to 0.3 wt %. According to another embodiment, the carbon content is of from 0.006 to 0.019 wt %.

Chromium, Cr, has strong impact on the corrosion resistance of the austenitic stainless steel as defined hereinabove or hereinafter, especially pitting corrosion. Cr improves the yield strength and counteracts transformation of austenitic structure to martensitic structure upon deformation of the austenitic stainless steel. However, an increasing content of Cr will result in for the formation of unwanted stable chromium nitride and sigma phase and a more rapid generation of sigma phase. According to one embodiment, the chromium content of the austenitic stainless steel used in the process disclosed hereinbefore and hereinafter is of from 26 to 28 wt %, such as of from 26.4 to 27.2 wt %.

Copper, Cu, has a positive effect on the corrosion resistance. Cu is either added purposively to the austenitic stainless steel as defined hereinabove or hereinafter or is already present in scrapped goods used for the production of steel and is allowed to remain therein. Too high levels of Cu will result in reduced hot workability and toughness and should therefore be avoided for those reasons. According to one embodiment, the copper content of the austenitic stainless steel used in the process disclosed hereinbefore and hereinafter is of from 0.6 to 1.4 wt %, such as 0.83 to 1.19 wt %.

Manganese, Mn, has a deformation hardening effect on the austenitic stainless steel as defined hereinabove or hereinafter. Mn is also known to form manganese sulfide together with sulfur present in the steel, thereby improving the hot workability. However, at too high levels, Mn tends to adversely affect both corrosion resistance and hot workability. According to one embodiment, the manganese content of the austenitic stainless steel used in the process disclosed hereinbefore and hereinafter is 0 to 2.5 wt %. According to one embodiment, the manganese content is of from 1.51 to 1.97 wt %.

Molybdenum, Mo, has a strong influence on the corrosion resistance of the austenitic stainless steel as defined hereinabove or hereinafter and it heavily influences the pitting resistance equivalent, PRE. Mo has also a positive effect on the yield strength and increases the temperature at which unwanted sigma-phases are stable and promotes its generation rate. Additionally, Mo has a ferrite-stabilizing effect. According to one embodiment, the molybdenum content of the austenitic stainless steel used in the process disclosed hereinbefore and hereinafter is of from 3 to 5.0 wt %, 3 to 4.4 wt %, such as 3.27 to 4.4 wt %.

Nickel, Ni, has a positive effect on the resistance against general corrosion. Ni also has a strong austenite-stabilizing effect and therefore plays a vital role in austenitic stainless steel. According to one embodiment, the nickel content of the austenitic stainless steel used in the process disclosed hereinbefore and hereinafter is of from 29.5 to 34 wt %, such as 30.3 to 31.3 wt %.

Nitrogen, N, has a positive effect on the corrosion resistance of the austenitic stainless steel as defined hereinabove or hereinafter and also contributes to deformation hardening. It has a strong effect on the pitting corrosion resistance equivalent PRE (PRE=Cr+3.3Mo+16N). It also has a strong austenite stabilizing effect and counteracts transformation from austenitic structure to martensitic structure upon plastic deformation of the austenitic stainless steel. According to one embodiment, the nitrogen content of the austenitic stainless steel used in the process disclosed hereinabove or hereinafter is 0 to 0.1 wt %. According to an alternative embodiment, N is added in an amount of from 0.03 wt % or higher. At too high levels, N tends to promote chromium nitrides, which should be avoided due to its negative effect on ductility and corrosion resistance. Thus, according to one embodiment, the content of N is therefore less than or equal to 0.09 wt %.

Silicon, Si, is often present in austenitic stainless steel since it may have been used for deoxidization earlier in the production thereof. Too high levels of Si may result in the precipitation of intermetallic compounds in connection to later heat treatments or welding of the austenitic stainless steel. Such precipitations will have a negative effect on corrosion resistance and workability. According to one embodiment, the silicon content of the austenitic stainless steel used in the process disclosed hereinabove or hereinafter is 0 to 1.0 wt %. According to one embodiment, the silicon content is of from 0.3 to 0.5 wt %.

Phosphorous, P, may be present as an impurity in the stainless steel used in the process disclosed hereinabove or hereinafter, and will result in deteriorated workability of the steel if at too high level, thus, P≤0.04 wt %.

Sulphur, S, may be present as an impurity in the stainless steel used in the process disclosed hereinabove or hereinafter and will result in deteriorated workability of the steel if at too high level, thus, S≤0.03 wt %.

Oxygen, O, may be present as an impurity in the stainless steel used in the process disclosed hereinabove or hereinafter, wherein O≤0.010 wt %.

Optionally small amounts of other alloying elements may be added to the duplex stainless steel as defined hereinabove or hereinafter in order to improve e.g. the machinability or the hot working properties, such as the hot ductility.

Example, but not limiting, of such elements are REM, Ca, Co, Ti, Nb, W, Sn, Ta, Mg, B, Pb and Ce. The amounts of one or more of these elements are of max 0.5 wt %. According to one embodiment, the duplex stainless steel as defined hereinabove or herein after may also comprise small amounts other alloying elements which may have been added during the process, e.g. Ca (≤0.01 wt %), Mg (≤0.01 wt %), and rare earth metals REM (≤0.2 wt %).

When the terms "max" or "less than or equal to" are used, the skilled person knows that the lower limit of the range is 0 wt % unless another number is specifically stated. The remainder of elements of the duplex stainless steel as defined hereinabove or hereinafter is Iron (Fe) and normally occurring impurities.

Examples of impurities are elements and compounds which have not been added on purpose, but cannot be fully avoided as they normally occur as impurities in e.g. the raw material or the additional alloying elements used for manufacturing of the martensitic stainless steel.

According to one embodiment, the duplex stainless steel consist of the alloying elements disclosed hereinabove or hereinafter in the ranges as disclosed hereinabove or hereinafter, According to one embodiment of the process as defined hereinabove or hereinafter, the austenitic steel comprises:

| | |
|---|---|
| C | 0.006-0.019; |
| Cr | 26.4-27.2; |
| Cu | 0.83-1.19; |
| Mn | 1.51-1.97; |
| Mo | 3.27-4.40; |
| N | 0.03-0.09; |
| Ni | 30.3-31.3; |
| Si | 0.3-0.5; |

balance Fe and unavoidable or acceptable impurities.

According to one embodiment of the process as defined hereinabove or hereinafter, 50%≤Rc.

According to one embodiment of the process as defined hereinabove or hereinafter, Rc≤68%.

According to one embodiment of the process as defined hereinabove or hereinafter, 60%≤Rh.

According to one embodiment of the process as defined hereinabove or hereinafter, Rh≤80%.

According to one embodiment of the process as defined hereinabove or hereinafter, 1.5≤Q.

According to one embodiment of the process as defined hereinabove or hereinafter, Q≤3.2.

According to one embodiment, the cold rolling step is performed such that the following formula is satisfied: $(2.5\times Rc+1.85\times Rh-17.7\times Q)\leq(R_{p0.2target}+49.3-1073\times C-21\times Cr-7.17\times Mo-833.3\times N)$. Accordingly, formula (1) is being used, wherein Z=0.

The present disclosure is further illustrated by the following non-limiting examples:

Examples

Melts of austenitic stainless steel of different chemical composition were prepared in an electric arc furnace. An AOD furnace was used in which decarburisation and desulphurisation treatment was conducted. The melts were then either casted into ingots (for production of tubes having larger outer diameter than 110 mm) or into billets by means of continuous casting (for production of tubes having smaller diameter than 110 mm). The casted austenitic stainless steel of the different melts were analysed with regard to chemical composition. Results are presented in table 1.

TABLE 1

Chemical composition of the melts

| Test No | C | Cr | Cu | Mn | Mo | N | Ni | P | S | Si |
|---|---|---|---|---|---|---|---|---|---|---|
| 1 | 0.008 | 26.6 | 0.9 | 1.7 | 3.3 | 0.047 | 30.5 | 0.015 | 0.001 | 0.430 |
| 2 | 0.013 | 26.7 | 1.0 | 1.8 | 3.3 | 0.056 | 30.6 | 0.018 | 0.001 | 0.400 |
| 3 | 0.011 | 26.6 | 1.0 | 1.7 | 3.3 | 0.055 | 30.8 | 0.016 | 0.001 | 0.430 |
| 4 | 0.005 | 26.4 | 0.9 | 1.1 | 4.4 | 0.097 | 33.2 | 0.018 | 0.001 | 0.230 |
| 5 | 0.010 | 26.6 | 1.1 | 1.6 | 3.3 | 0.079 | 30.4 | 0.021 | 0.001 | 0.420 |
| 6 | 0.012 | 26.4 | 0.9 | 0.9 | 4.3 | 0.087 | 33.5 | 0.016 | 0.001 | 0.190 |
| 7 | 0.008 | 27.0 | 0.9 | 1.6 | 3.3 | 0.082 | 30.5 | 0.019 | 0.001 | 0.450 |
| 8 | 0.010 | 26.6 | 1.1 | 1.6 | 3.3 | 0.079 | 30.4 | 0.021 | 0.001 | 0.420 |
| 9 | 0.010 | 27.0 | 0.9 | 1.7 | 3.3 | 0.055 | 30.5 | 0.017 | 0.001 | 0.490 |
| 10 | 0.014 | 26.9 | 1.0 | 1.7 | 3.3 | 0.088 | 30.5 | 0.018 | 0.001 | 0.420 |

The produced ingots or billets were subjected to a heat deformation process in which they were extruded into a plurality of tubes. These tubes were subjected to a cold deformation in which they were cold rolled in a pilger mill to their respective final dimensions. For each of the test numbers presented in table 1 10-40 of tubes were thus produced using the same values for Rc, Rh and Q. Target yield strength was set for the respective test number, and Rc, Rh and Q were determined with regard taken to the target yield strength such that equation 1 presented hereinabove was satisfied. The cold rolling was performed in one cold rolling step.

For each tube, the yield strength was measured for two test samples in accordance with ISO 6892, thus resulting in a plurality of yield strength measurements for each test number. For each test number, average yield strength was calculated on basis of said measurement. The average yield strength was compared to the target yield strength. Results are presented in table 2. The deviation of the individual measurements from the targeted yield strength was also registered. Deviations were less than +/−65 MPa from the targeted yield strength.

TABLE 2

Results

| Test No | OD in | Wt in | Q | Rc | OD out | Wt out | Rp0.2 average | Rh | $R_{p0.2\ target}$ |
|---|---|---|---|---|---|---|---|---|---|
| 1 | 237 | 18.5 | 1.9 | 56.8 | 178.5 | 10.4 | 860 | 81.8 | 854.6 |
| 2 | 258 | 30.7 | 1 | 42.6 | 196.5 | 23.1 | 871 | 68.8 | 852.9 |
| 3 | 227.6 | 25 | 3.4 | 65.5 | 178.5 | 10.4 | 843 | 79.1 | 867.8 |
| 4 | 121 | 9.5 | 1.2 | 49.4 | 88.9 | 6.5 | 905 | 86.3 | 902.1 |
| 5 | 172 | 22 | 1.6 | 65.7 | 114.6 | 10.9 | 900 | 80.5 | 913.8 |
| 6 | 158 | 14 | 1.5 | 54.8 | 114.6 | 8.6 | 932 | 85.1 | 917.6 |
| 7 | 180 | 22.5 | 2.1 | 65.6 | 127.6 | 10.4 | 932 | 78.7 | 912.9 |
| 8 | 190 | 26 | 1.8 | 67.9 | 127 | 11.9 | 906 | 74.3 | 908.4 |

TABLE 2-continued

| Results | | | | | | | | | |
|---|---|---|---|---|---|---|---|---|---|
| Test No | OD in | Wt in | Q | Rc | OD out | Wt out | Rp0.2 average | Rh | $R_{p0.2\ target}$ |
| 9 | 197 | 29 | 2.1 | 49 | 155.5 | 18.1 | 865 | 70.7 | 851.6 |
| 10 | 215 | 29 | 2.4 | 66.4 | 155.6 | 12.7 | 901 | 78.3 | 934.0 |

wherein

"OD in" is the outer diameter of the tube before cold deformation,

"Wt in" is the wall thickness before cold deformation,

"OD out" is the outer diameter of the tube after cold deformation, and

"Wt out" is the wall thickness after cold deformation.

It could thus be concluded that equation (1) serves as a good tool for deciding Rh, Rc and Q on basis of the chemical composition of the stainless steel and a chosen target yield strength. For a particular tube, having a predetermined final outer diameter and predetermined final wall thickness, and outgoing from a billet of predetermined geometry, in particular cross-sectional area, the use of equation (1) will enable the skilled practitioner to choose a suitable hot reduction as well as cold reduction and Q-value without need of experimentation. Iterative calculation may be used in order to arrive at satisfaction of equation (1). Provided that equation (1) is satisfied, and the that the stainless steel has a composition as defined hereinabove, the yield strength of individual tube samples from one and the same ingot or billet will not deviate more than approximately +/−65 MPa from the targeted yield value.

The invention claimed is:

1. A process of producing an austenitic stainless steel tube, comprising:

a) producing an ingot or a continuous casted billet of the austenitic stainless steel, wherein said austenitic stainless steel has a composition (in weight %),

| | |
|---|---|
| C | 0-0.3; |
| Cr | 26-28; |
| Cu | 0.6-1.4; |
| Mn | 0-2.5; |
| Mo | 3-4.4; |
| N | 0-0.1; |
| Ni | 29.5-34; |
| Si | 0-1.0; |

balance Fe and unavoidable impurities;

b) determining a value for degree of hot reduction (Rh), a value for degree of cold reduction (Rc), and a value of Q based on the composition of the austenitic stainless steel and a target yield strength such that formula (1) is satisfied;

c) hot extruding the ingot or the billet obtained from step a) into a tube, wherein hot extruding includes:

selecting hot reduction parameters of a cross section of the ingot or the billet before hot extruding (a0) and a cross section area of the tube after hot extruding (a1), where $$Rh = 1 - \frac{a1}{a0}$$

and the value for degree of hot reduction (Rh) is that obtained from step b), and actively hot reducing the ingot or the billet from the cross section a0 to form the tube having the cross section area a1; and d) cold rolling the tube obtained from step c) to a final dimension thereof, wherein cold rolling includes:

selecting cold reduction parameters of a cross section area of the tube before cold rolling (A0) and a cross section area of the tube after cold rolling (A1), where $$Rc = 1 - \frac{A1}{A0}$$

and the value for degree of cold reduction (Rc) is that obtained from step b), and actively cold rolling the tube from the cross section area A0 to the cross section area A1, wherein the outer diameter D of the cold rolled tube is 70-250 mm and the thickness t thereof is 6-25 mm, and wherein formula (1) is:

$$(2.5\times Rc+1.85\times Rh-17.7\times Q)=(Rp0.2\text{target}+49.3-1073\times C-21\times Cr-7.17\times Mo-833.3\times N)\pm Z \quad (1)$$

where

Q is (W0−W1)×(OD0−W0)/W0((OD0−W0)−(OD1−W1)), wherein W1 is tube wall thickness after cold rolling, W0 is tube wall thickness before cold rolling, OD1 is outer diameter of tube after cold rolling, and OD0 is outer diameter of tube before cold rolling, Rp0.2target is the target yield strength and is $750 \le R_{p0.2target} \le 1000$ MPa, 30%≤Rc≤75%, 50%≤Rh≤90%, 1≤Q≤3.6, and Z is 65, and C, Cr, Mo and N are the contents (in weight %) of each respective element.

2. The process according to claim 1, wherein 50≤Rc≤75%.

3. The process according to claim 1, wherein 30%≤Rc≤68%.

4. The process according to claim 1, wherein 60%≤Rh≤90%.

5. The process according to claim 1, wherein 50%≤Rh≤80%.

6. The process according to claim 1, wherein 1.5≤Q≤3.6.

7. The process according to claim 1, wherein 1≤Q≤3.2.

8. The process according to claim 1, wherein the austenitic stainless steel has the composition:

| | |
|---|---|
| C | 0.006-0.019; |
| Cr | 26.4-27.2; |
| Cu | 0.83-1.19; |
| Mn | 1.51-1.97; |

-continued

| | |
|---|---|
| Mo | 3.27-4.40; |
| N | 0.03-0.09; |
| Ni | 30.3-31.3; |
| Si | 0.3-0.5; |

balance Fe and unavoidable impurities.

9. The process according to claim 1, wherein 50%≤Rc≤68%, wherein 60%≤Rh≤80%, and wherein 1.5≤Q≤3.2.

10. The process according to claim 9, wherein the austenitic stainless steel has the composition:

| | |
|---|---|
| C | 0.006-0.019; |
| Cr | 26.4-27.2; |
| Cu | 0.83-1.19; |
| Mn | 1.51-1.97; |
| Mo | 3.27-4.40; |

-continued

| | |
|---|---|
| N | 0.03-0.09; |
| Ni | 30.3-31.3; |
| Si | 0.3-0.5; |

balance Fe and unavoidable impurities.

11. The process according to claim 1, wherein the cold rolling step is a single cold rolling step.

12. The process according to claim 1, wherein the cold rolling step is performed in a pilger mill.

13. The process according to claim 1, wherein determining the value for degree of hot reduction (Rh), the value for degree of cold reduction (Rc), and the value of Q is done iteratively.

14. The process according to claim 1, wherein a yield strength of the cold rolled tube is within 65 MPa of the target yield strength.

* * * * *